US008354212B2

(12) United States Patent
Hayata et al.

(10) Patent No.: US 8,354,212 B2
(45) Date of Patent: Jan. 15, 2013

(54) ELECTROPHOTOGRAPHIC PHOTORECEPTOR, IMAGE FORMING APPARATUS, AND METHOD FOR IMAGE FORMATION

(75) Inventors: Hirofumi Hayata, Fuchu (JP); Takeshi Ishida, Hachioji (JP); Masahiko Kurachi, Hino (JP); Toshiyuki Fujita, Hachioji (JP); Seisuke Maeda, Akishima (JP); Seijiro Takahashi, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 269 days.

(21) Appl. No.: 12/988,770

(22) PCT Filed: Sep. 17, 2009

(86) PCT No.: PCT/JP2009/066248

§ 371 (c)(1),
(2), (4) Date: Oct. 20, 2010

(87) PCT Pub. No.: WO2010/035683

PCT Pub. Date: Apr. 1, 2010

(65) Prior Publication Data

US 2011/0038651 A1 Feb. 17, 2011

(30) Foreign Application Priority Data

Sep. 26, 2008 (JP) ..... 2008-247576

(51) Int. Cl.
*G03G 15/02* (2006.01)

(52) U.S. Cl. ..... 430/66

(58) Field of Classification Search ..... 430/66
See application file for complete search history.

(56) References Cited

U.S. PATENT DOCUMENTS

2006/0188905 A1* 8/2006 Fonnum et al. ..... 435/6

FOREIGN PATENT DOCUMENTS

| | | |
|---|---|---|
| JP | H04-338961 | 11/1992 |
| JP | H05-265244 | 10/1993 |
| JP | H06-019176 | 1/1994 |
| JP | 11-288121 | 10/1999 |

(Continued)

OTHER PUBLICATIONS

Notice of Reasons for Refusal for application No. 2010-530821, mailed Aug. 28, 2012, 5 pgs.

(Continued)

*Primary Examiner* — Hoa V Le
(74) *Attorney, Agent, or Firm* — Squire Sanders (US) LLP

(57) ABSTRACT

Disclosed is an electrophotogaphic photoreceptor that causes little or no abrasion-derived uneven image density and does not cause scratches and image defects attributable to the occurrence of scratches even after a large volume, for example, exceeding 1,000,000 sheets of printing, and that does not cause image blurring even after printing in an environment of a high-temperature and a high-relative humidity (RH) respectively exceeding 30° C. and 80%. The electrophotographic photoreceptor comprises an electroconductive support and at least a photosensitive layer and a surface layer provided on the electroconductive support and is characterized in that the surface layer contains at least a compound obtained by reacting a polymerizable compound containing a methacryl group with particles containing a functional group reactive with the methacryl group and, in the polymerizable compound, the ratio between the number of methacryl groups and the molecular weight (number of methacryl groups/molecular weight) is not less than 0.0055.

6 Claims, 1 Drawing Sheet

FOREIGN PATENT DOCUMENTS

| | | |
|---|---|---|
| JP | 2000-131867 | 5/2000 |
| JP | 2000-310871 | 11/2000 |
| JP | 2002-333733 | 11/2002 |
| JP | 2010-524694 | 7/2009 |
| WO | WO 2010/018725 | 2/2010 |

OTHER PUBLICATIONS

Translation of Notice of Reasons for Refusal for application No. 2010-530821, mailed Aug. 28, 2012, 7 pgs.

* cited by examiner

ELECTROPHOTOGRAPHIC PHOTORECEPTOR, IMAGE FORMING APPARATUS, AND METHOD FOR IMAGE FORMATION

TECHNICAL FIELD

The present invention relates to an electrophotographic photoreceptor, an image forming apparatus installing the electrophotographic photoreceptor, and method for image formation using the electrophotographic photoreceptor thereof.

BACKGROUND

As for an electrophotographic photoreceptor (hereinafter, simply referred to as a photoreceptor), it is required to provide a predetermined sensitivity, electric properties and photo properties according to used electrophotographic process. Especially, as for a surface layer which is a farthest region from a substrate and is subjected to an electrical and mechanical force such as charging, exposing, transferring, or cleaning, it is required to provide a durability to maintain the above properties stably, even though image formation is carried out repeatedly. Specifically, it is required to provide enough durability to generation of an abrasion or scratch on a surface by rubbing and deterioration by ozone or nitrogen oxide generating at charging process.

From the background above, investigated were technologies which enhance a mechanical strength of photoreceptor surface by providing a surface layer. Specifically, investigated were technologies which enhance durability to an abrasion or scratch by increasing surface hardness of a photoreceptor (for example, Patent Document 1).

Further, investigated was technology which further enhances a mechanical strength of a surface layer by dispersing inorganic particles such as silica in a surface layer, as well as using a resin having a cross-linking structure (for example, Patent Document 2).

In this photoreceptor having a surface layer using a resin having a cross-linking structure, a mechanical strength of photoreceptor surface can be enhanced, but an electrical property on a photoreceptor surface is affected. Specifically, when an image was formed under an ambient of high temperature and high humidity, it was found that corona product such as ozone or nitrogen oxide which was generated by repeatedly charging, tended to adhere to a surface of a photoreceptor. These corona products adhered on a surface of a photoreceptor caused to decreasing a surface resistivity of a photoreceptor and resulted in a defect of an image such as blur.

Consequently, in a photoreceptor having a surface layer using a resin having a cross-linking structure, a balance between an electrical performance and a mechanical performance becomes problematic, because stable electrical performance tended to be difficult to be achieved when a mechanical strength was enhanced.

On the other hand, a need for balancing long life and high quality of an electrophotographic photoreceptor was increasing day by day, because in the market, there becomes a need for forming a lot of print more than one million papers scale by using an electrophotographic image forming apparatus.

Therefore, required was a photoreceptor which can have an excellent durability to generation of an abrasion or scratch on a surface by rubbing repeatedly in an image forming process and have an excellent charging potential property even when an image was printed repeatedly under an ambient of high temperature and high humidity.

PRIOR ART DOCUMENT

Patent Document

Patent Document 1: Unexamined Japanese Patent Application (hereinafter, refers to as JP-A) No. 11-288121

Patent Document 2: JP-A No. 2002-333733

SUMMARY

Problems to be Solved by the Present Invention

In view of the foregoing, the present invention was achieved. An object of the present invention is to provide an electrophotographic photoreceptor which prevents from generation of an uneven density caused by abrasion and an image defect caused by scratch line after a lot of printing more than one million papers, as well as generation of blur even when an image was printed repeatedly under an ambient of high temperature and high humidity.

Means to Solve the Problems

An object of the present invention described above has been achieved by the following constitutions.

1. An electrophotographic photoreceptor comprising an electroconductive support provided thereon at least a photosensitive layer and a surface layer, wherein the surface layer contains at least a compound obtained by reacting a polymerizable compound containing a methacryl group with particles containing a functional group reactive with the methacryl group and, in the polymerizable compound, the ratio between the number of methacryl groups and the molecular weight (number of methacryl groups/molecular weight) is 0.0055 or more.
2. The electrophotographic photoreceptor of item 1, wherein in the polymerizable compound, the ratio between the number of methacryl groups and the molecular weight (number of methacryl groups/molecular weight) is 0.0055 or more and 0.0100 or less.
3. The electrophotographic photoreceptor of item 1 or 2, wherein particles are formed by using metal oxide particles.
4. The electrophotographic photoreceptor of any one of items 1 to 3, wherein particles are treated by a coupling agent.
5. An image forming apparatus at least comprising: the electrophotographic photoreceptor of any one of items 1 to 4, a charging member which charges the electrophotographic photoreceptor without touching, an exposure member which exposes on the charged electrophotographic photoreceptor by the charging member, and a developing member which supplies a developer onto the exposed electrophotographic photoreceptor by the exposure member.
6. A method for an image forming comprising steps of: charging the electrophotographic photoreceptor of any one of claims 1 to 4 without touching, exposing the charged electrophotographic photoreceptor by the charging step, and developing by supplying a developer onto the exposed electrophotographic photoreceptor by the exposing step.

Effects of the Invention

The electrophotographic photoreceptor of the present invention made it possible to print stably by preventing from generation of an uneven density caused by abrasion and an image defect caused by scratch line after a lot of printing more than one million papers. Further, it made it possible to print stably by preventing generation of blur even when an image was printed repeatedly under an ambient of high temperature and high humidity such as temperature of 30° C. and relative humidity of 80%.

DESCRIPTION OF THE PREFERRED EMBODIMENT

Figure 1:
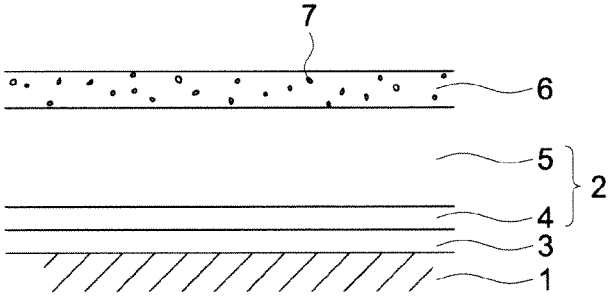
FIG. 1 is a schematic view showing constitution of layers of a photoreceptor of the present invention.

The present invention relates to an electrophotographic photoreceptor, comprising an electroconductive support provided thereon at least a photosensitive layer and a surface layer. In view of the foregoing, the inventors of the present invention conducted diligent investigations. As a result, the following was discovered, and the present invention was achieved.

Namely, provided is an electrophotographic photoreceptor comprising an electroconductive support provided thereon at least a photosensitive layer and a surface layer, wherein the surface layer contains at least a compound obtained by reacting a polymerizable compound containing a methacryl group with particles containing a functional group reactive with the methacryl group and, in the polymerizable compound, the ratio between the number of methacryl groups and the molecular weight (number of methacryl groups/molecular weight) is 0.0055 or more. Consequently, it is found that the constitution of the electrophotographic photoreceptor made it possible to print continuously with less abrasion, and without generation of scratch line, resulting in excellent quality print without having an uneven density caused by abrasion and an image defect caused by scratch line even after a lot of printing more than one million papers. Further, it is found that it made it possible to print stably by preventing generation of blur even when an image was printed repeatedly even under an ambient of high temperature and high humidity such as temperature of 30° C. and relative humidity of 80%.

Herein, "polymerizable compound" refers to an organic compound having a functional group which can contribute a polymerization reaction, namely a reactive organic compound called such as "monomer" or "monomeric substance"; or an organic compound called "multimeric substance" which has two or more monomer structure units as constitution unit and has reactive functional group at its terminal. In "multimeric substance", one having a number of constitution units being 2-20 is generally called as "olygomer". Polymerizable compound of the present invention may be a monomer or a multimeric substance represented by olygomer.

Further, according to the present invention, the ratio between the number of methacryl groups and the molecular weight (number of methacryl groups/molecular weight) of the polymerizable compound is 0.0055 or more. Thus, the polymerizable compound is specified by above ratio, and results in decreasing a number of methacryl groups of the compound formed in the surface layer by reacting the methacryl group in the polymerizable compound and the functional group of the particles described later.

Thus, it is speculated that to decrease a number of unreacted methacryl groups remained in the formed compound results in enhancing a mechanical strength of the surface layer, and reducing absorbed amount of water. Further, a decomposition of a surface layer by an active gas such as nitrogen oxide may be prevented and these reactions may be speculated to result in reducing abrasion and lowering of an electric resistance at the surface of the photoreceptor.

As the result, it has become possible to provide the photoreceptor which can print stably by preventing from generation of an uneven density caused by abrasion and an image defect caused by scratch line after a lot of printing more than one million papers. Further, it has become possible to provide the photoreceptor which can print stably by preventing generation of blur even when an image was printed repeatedly under an ambient of high temperature and high humidity such as temperature of 30° C. and relative humidity of 80%.

The present invention will now be further detailed.

(Layer Constitution of Photoreceptor)

The photoreceptor of the present invention comprises an electroconductive support provided thereon at least a photosensitive layer and a surface layer. Layer constitution of photosensitive layer of the present invention is not limited and for example, exemplified as bellows.

(1) Layer constitution comprising an electroconductive support laminated thereon a charge generation layer, a charge transporting layer and a surface layer in this order.

(2) Layer constitution comprising an electroconductive support laminated thereon a single photosensitive layer containing charge transporting material and charge generating material, and a surface layer.

(3) Layer constitution comprising an electroconductive support laminated thereon an intermediate layer, charge generation layer, a charge transporting layer and a surface layer in this order.

(4) Layer constitution comprising an electroconductive support laminated thereon an intermediate layer, a single photosensitive layer containing charge transporting material and charge generating material, and a surface layer.

The photoreceptor of the present invention may be any one of a layer constitution represented by above (1) to (4). Of these, "Layer constitution comprising an electroconductive support laminated thereon an intermediate layer, charge generation layer, a charge transporting layer and a surface layer in this order" represented by (3) may be preferable.

FIG. 1 is schematic view showing constitution of layers of above (3) which is one of preferable constitution of layers of a photoreceptor of the present invention.

In FIG. 1, 1 represents electroconductive support, 3 represents intermediate layer, 4 represents charge generation layer, 5 represents charge transporting layer, 6 represents surface layer and photosensitive layer 2 comprises charge generation layer 4 and charge transporting layer 5. 7 which is included in surface layer 6 represents particles and functional group provided on the surface thereof forms compound by reacting with metacryl group of polymerizable compound described later.

As described before, in the photoreceptor of the present invention, the surface layer formed at most surface is formed at least by reacting with polymerizable compound having metacryl group and particles reactive with foresaid methacryl group.

1. Surface Layer

"Surface layer" which constitutes the photoreceptor of the present invention will be described in details as below. Electroconductive support, intermediate layer, charge generation layer, and charge transporting layer which constitutes the photoreceptor of the present invention will be described later.

Herein, "Surface layer" which constitutes the photoreceptor of the present invention is a layer which forms interface between photoreceptor and air, and constructs a surface of photoreceptor.

Surface layer which constitutes the photoreceptor of the present invention includes at least polymerizable compound having metacryl group and particles reactive functional group with foresaid methacryl group.

The polymerizable compound having metacryl group, particles reactive with foresaid methacryl group and compound formed by reacting metacryl group of foresaid polymerizable compound and functional group of foresaid particles will now be exemplified.

(Polymerizable Compound Having Methacryl Group)

The polymerizable compound having methacryl group in the present invention is also referred to as curable compound, and methacryl group thereof can react with a functional group provided on surface of particles described later by irradiation of ultraviolet ray or actinic energy radiation. Further, reaction between polymerizable compounds can be available. In the present invention, it is considered that the polymerizable compound has remarkable effect on resolving the objects of the present invention by having methacryl group in molecular structure thereof.

Namely, it is considered that polymerizable compound can proceed in polymerization under slight light amount or in short time, resulting in curing by resin forming; and methacryl group in molecular structure may contribute to proceed in polymerization under these conditions.

Herein, "methacryl group" in the present invention is a group having a structure represents by $CH_2{=}C(CH_3)COO{-}$.

The polymerizable compound used in the present invention preferably comprises 3 or more methacryl groups in the molecular structure, more preferably 5 or more methacryl groups.

In the present invention, the polymerizable compound is defined by the ratio between the number of methacryl groups and the molecular weight, namely "number of methacryl groups/molecular weight". The value is 0.0055 or more and preferably 0.0055-0.0100. By employing the polymerizable compound defined by these values, it is considered that cross-linking density becomes higher in formed surface layer and results in enhancing humidity resistance and abrasion resistance of the photoreceptor.

Further, two or more polymerizable compounds having different number of methacryl groups may be used in combination. When the surface layer is formed by combination with a plurality kind of polymerizable compounds, "the ratio between the number of methacryl groups and the molecular weight" can be calculated by summing up the product of "the ratio between the number of methacryl groups and the molecular weight" of each polymerizable compound and "ratio of addition" of the compound.

For example, when a surface layer is formed by employing three kind of polymerizable compounds A, B, and C, "the ratio between the number of methacryl groups and the molecular weight" is calculated by following procedure. When a surface layer is formed by adding a parts by mass of polymerizable compound A (the number of methacryl group is 3 and molecular weight is M1), b parts by mass of polymerizable compound B (the number of methacryl group is 2 and molecular weight is M2), and c parts by mass of polymerizable compound C (the number of methacryl group is 5 and molecular weight is M3) each, "the ratio between the number of methacryl groups and the molecular weight" is calculated as follows.

$$(\text{Ratio of methacryl groups/molecular weight})=[(3/M1)\times\{a/(a+b+c)\}]+\{(2/M2)\times\{b/(a+b+c)\}]+[(5/M3)\times\{c/(a+b+c)\}].$$

Herein, specific polymerizable compounds having methacryl group will now be exemplified, however the polymerizable compounds having methacryl group employable in the present invention is not limited thereto. Herein, "the number of methacryl groups" in the exemplified compound represents the number methacryl groups in the structural formula and "ratio" represents the ratio between the number of methacryl groups and the molecular weight (number of methacryl groups/molecular weight), as described above. Further, R represented in each exemplified compound is the structure below.

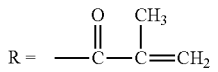

| Exemplified example No. | Chemical structure | Methacrylic acid group | Ratio |
|---|---|---|---|
| (1) | 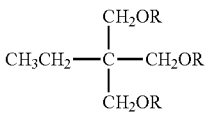 | 3 | 0.0089 |
| (2) | 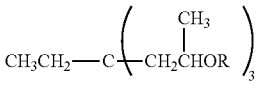 | 3 | 0.0072 |
| (3) | 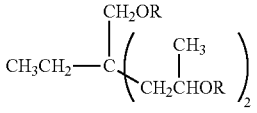 | 3 | 0.0076 |

-continued
| Exemplified example No. | Chemical structure | Methacrylic acid group | Ratio |
|---|---|---|---|
| (4) | 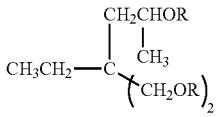 | 3 | 0.0082 |
| (5) | 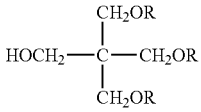 | 3 | 0.0088 |
| (6) | 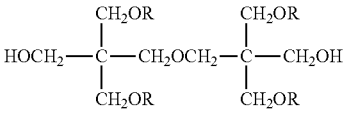 | 4 | 0.0080 |
| (7) | 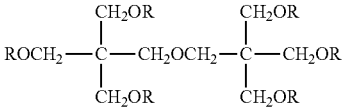 | 6 | 0.0091 |
| (8) | 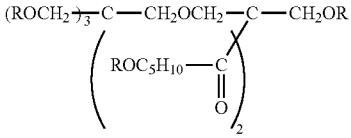 | 6 | 0.0072 |
| (9) | 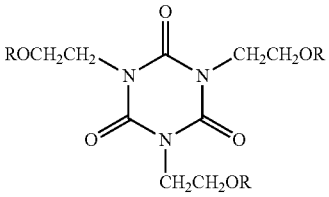 | 3 | 0.0064 |
| (12) | 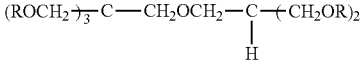 | 5 | 0.0089 |
| (13) | 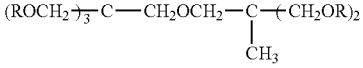 | 5 | 0.0087 |
| (14) | 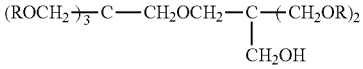 | 5 | 0.0084 |
| (15) | 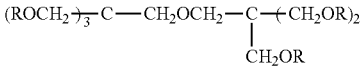 | 4 | 0.0076 |
| (16) | 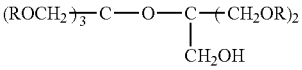 | 5 | 0.0088 |
| (17) | 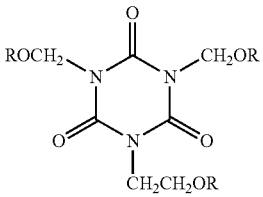 | 3 | 0.0069 |
| (18) | 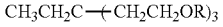 | 3 | 0.0070 |

-continued

| Exemplified example No. | Chemical structure | Methacrylic acid group | Ratio |
|---|---|---|---|
| (20) | 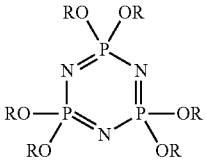 | 6 | 0.0093 |
| (24) | $R-(OC_3H_6)_3-OR$ | 2 | 0.0061 |
| (27) | 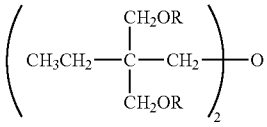 | 4 | 0.0077 |
| (28) | $(ROCH_2)_3-C$ | 4 | 0.0098 |
| (29) | $RO-C_6H_{12}-OR$ | 2 | 0.0079 |
| (30) | 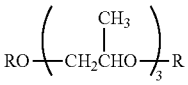 | 2 | 0.0061 |
| (32) | 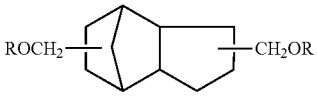 | 2 | 0.0060 |
| (34) | 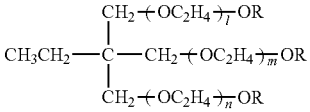 (l + m + n = 3) | 3 | 0.0063 |
| (37) | $(ROCH_2)_3CCH_2OCONH(CH_2)_6NHCOOCH_2C(CH_2OR)_3$ | 6 | 0.0071 |
| (38) | 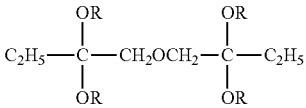 | 4 | 0.0086 |
| (39) | 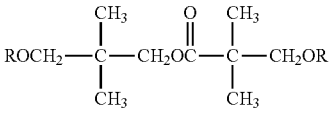 | 2 | 0.0059 |
| (40) | 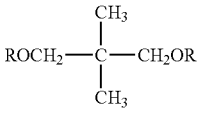 | 2 | 0.0083 |

Other than above compounds, employable are compounds of multimeric substance, for example, such as epoxy methacrylate olygomer, urethane methacrylate olygomer, and polyester methacrylate olygomer having 0.0050 or more of the ratio between the number of methacryl groups and the molecular weight (number of methacryl groups/molecular weight).

(Particles Having Reactive Functional Group with Methacryl Group)

"Particles having reactive functional group with methacryl group of the polymerizable compound"constituting the photoreceptor of the present invention will now be further detailed.

As described later, "particles having reactive functional group with methacryl group" of the present invention is obtained by surface-treating surface of particles with a compound having reactive functional group with methacryl group.

Particle size of "particles having reactive functional group with methacryl group" is preferably 600 nm or less, more preferably 300 nm or less as an average particle diameter. Inorganic particles and organic particles may be listed as these particles.

Of these, metal oxide particles are preferable as inorganic particles. Specific examples include: zinc oxide, titanium oxide, aluminum oxide, tin oxide, antimony oxide, indium oxide, bismuth oxide, tin doped indium oxide, antimony doped tin oxide and zirconium oxide. Of these, titanium oxide is preferred in view of having high specific inductive capacity. These metal oxides may be employed in combinations of at least two types.

Further, particles having surface structure reactive with a compound having functional group reactive with methacryl group (surface treatment agent) is preferable as organic particles. Specific examples include: polyvinylidene fluoride resin particles, chlorotrifluoroethylene resin particles, polychlorotrifluoroethylene resin particles, polyvinylfluoride resin particles, polytetrafluoroethylene resin particles, and silicone resin particles. Of these, polytetrafluoroethylene resin particles are preferred.

In the case of organic particles, a content of "particles having reactive functional group with methacryl group" is preferably 10-100% by mass, more preferably 20-80% by mass based on "polymerizable compound having methacryl group". In the case of inorganic particles, content is preferably 20-400% by mass, more preferably 50-300%.

It is possible to prevent blade flection caused by increasing torque by adding organic particles in an amount of 10% or more by mass due to decreasing a friction coefficient to a cleaning blade. Further, it is possible especially to prevent filming occurred under an ambient of low temperature by adding organic particles in an amount of 100% or less by mass due to increasing scratch resistivity.

It is possible to prevent increasing residual potential or toner fog by adding inorganic particles in an amount of 20% or more by mass due to inhibiting an excess increasing resistivity of surface layer. Further, it is possible to prevent decreasing charging property or generation of pinhole by adding inorganic particles in an amount of 400% or less by mass due to having good film formation.

The reactive functional group with methacryl group provided on the particle surface, for example, include radical polymerizable functional group such as acryloyl group, methacryloyl group and vinyl group.

The compound which can provide a functional group reactive with methacryl group by surface treatment includes a compound represented by Formula (1), for example.

Formula (1)

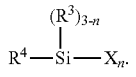

X in Formula (1) represents any one of a halogen atom, an alkoxy group, an acyloxy group, an aminoxy group and a phenoxy group, and n represents an integer of 1-3, $R^3$ represents an alkyl group having 1-10 carbon atoms and an aralkyl group, and $R^4$ represents an organic group having a double bond which can be polymerized.

A compound represented by Formula (1) is generally called as silane compounds. Particles having reactive functional group with methacryl group is prepared by surface treating above particles by using compound represented by Formula (1) under "a procedure of surface treatment" described later.

Specific examples include silane compounds represented by Formula (1) as below:

S-1: $CH_2{=}CHSi(CH_3)(OCH_3)_2$
S-2: $CH_2{=}CHSi(OCH_3)_3$
S-3: $CH_2{=}CHSiCl_3$
S-4: $CH_2{=}CHCOO(CH_2)_2Si(CH_3)(OCH_3)_2$
S-5: $CH_2{=}CHCOO(CH_2)_2Si(OCH_3)_3$
S-6: $CH_2{=}CHCOO(CH_2)_2Si(OC_2H_5(OCH_3)_2$
S-7: $CH_2{=}CHCOO(CH_2)_3Si(OCH_3)_3$
S-8: $CH_2{=}CHCOO(CH_2)_2Si(CH_3)Cl_2$
S-9: $CH_2{=}CHCOO(CH_2)_2SiCl_3$
S-10: $CH_2{=}CHCOO(CH_2)_3Si(CH_3)Cl_2$
S-11: $CH_2{=}CHCOO(CH_2)_3SiCl_3$
S-12: $CH_2{=}C(CH_3)COO(CH_2)_2Si(CH_3)(OCH_3)_2$
S-13: $CH_2{=}C(CH_3)COO(CH_2)_2Si(OCH_3)_3$
S-14: $CH_2{=}C(CH_3)COO(CH_2)_3Si(CH_3)(OCH_3)_2$
S-15: $CH_2{=}C(CH_3)COO(CH_2)_3Si(OCH_3)_3$
S-16: $CH_2{=}C(CH_3)COO(CH_2)_2Si(CH_3)Cl_2$
S-17: $CH_2{=}C(CH_3)COO(CH_2)_2SiCl_3$
S-18: $CH_2{=}C(CH_3)COO(CH_2)_3Si(CH_3)Cl_2$
S-19: $CH_2{=}C(CH_3)COO(CH_2)_3SiCl_3$
S-20: $CH_2{=}CHSi(C_2H_5)(OCH_3)_2$
S-21: $CH_2{=}C(CH_3)Si(OCH_3)_3$
S-22: $CH_2{=}C(CH_3)Si(OC_2H_5)_3$
S-23: $CH_2{=}CHSi(OCH_3)_3$
S-24: $CH_2{=}C(CH_3)Si(CH_3)(OCH_3)_2$
S-25: $CH_2{=}CHSi(CH_3)Cl_2$
S-26: $CH_2{=}CHCOOSi(OCH_3)_3$
S-27: $CH_2{=}CHCOOSi(OC_2H_5)_3$
S-28: $CH_2{=}C(CH_3)COOSi(OCH_3)_3$
S-29: $CH_2{=}C(CH_3)COOSi(OC_2H_5)_3$
S-30: $CH_2{=}C(CH_3)COO(CH_2)_3Si(OC_2H_5)_3$
S-31: $CH_2{=}CHCOO(CH_2)_2Si(CH_3)_2(OCH_3)$
S-32: $CH_2{=}CHCOO(CH_2)_2Si(CH_3)(OCOCH_3)_2$
S-33: $CH_2{=}CHCOO(CH_2)_2Si(CH_3)(ONHCH_3)_2$
S-34: $CH_2{=}CHCOO(CH_2)_2Si(CH_3)(OC_6H_5)_2$
S-35: $CH_5{=}CHCOO(CH_2)_2Si(C_{10}H_{21}(OCH_3)_2$
S-36: $CH_2{=}CHCOO(CH_2)_2Si(CH_2C_6H_5)(OCH_3)_2$

Further, silane compounds having radical polymerizable organic group listed below may be usable, other than compound represented by Formula (1).

S-37

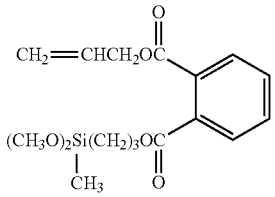

S-38

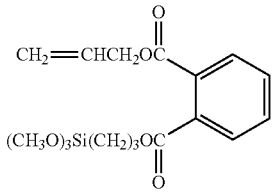

-continued

S-39

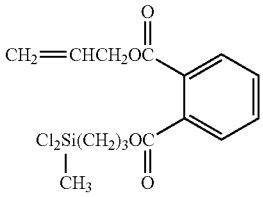

S-40

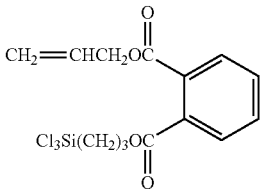

These silane compounds may be employed individually or in combinations of at least two types. Further, silane compounds having radical polymerizable organic group listed below may be usable, other than silane compound listed above.

(Procedure of Surface Treatment)

As previously described, "particles having reactive functional group with methacryl group" of the present invention can be prepared by surface treating particles by using a compound having reactive functional group with methacryl group.

As a compound having reactive functional group with methacryl group, listed are conventional coupling agent represented by above silane compound.

Procedure of surface treatment by using coupling agent will now specifically be described. As contents of particles for surface treated, coupling agent and solvent, for example, preferred is 0.1-100 parts by mass of coupling agent, 50-5,000 parts by mass of solvent each based on 100 parts by mass of particles. Further, as an apparatus for surface treatment, preferred is a wet media dispersing type apparatus and also dry type surface treatment apparatus can be employable.

In a surface treatment by a wet media dispersing type apparatus, surface treatment proceeds by pulverizing slurry in which particles and coupling agent are dispersed in solvent (suspension of solid particles) as well as finely pulverizing particles. Then, solvent is removed to have powder, and particles uniformly surface treated with coupling agent, that is "particles having reactive functional group with methacryl group" can be obtained.

The wet media dispersing type apparatus utilized as the surface treatment apparatus in the invention is an apparatus which has beads in a vessel as a dispersion media, and by rotating a rotating shaft and agitation disk mounted perpendicular on the rotating shaft in high speed, coagulated metal oxide particles are ground and dispersed. Various types of apparatus can be applicable such as vertical type, horizontal type, continuous type and batch type which can disperse and surface treat, when it can fully disperse and treat surface of metal oxide particles. Specifically sand mill, Ultra visco mill, Pearl mill, Grain mill, DINO-mill, Agitator Mill, and Dynamic mill are usable.

In these wet media dispersing type dispersing apparatus, fine grinding and dispersion are carried out via impact crush, friction, shear force, and shear stress by using pulverizing media such as beads described above. As beads used in the sand grinder mill, balls made from such as glass, aluminum, zircon, zirconia, steel, and flint are usable. Specifically, zirconia or zircon is preferred. Diameter of beads is generally 1-2 mm, preferably 0.3-1.0 mm in the invention.

As disk and inner wall of vessel used in a wet media dispersing type apparatus, various materials such as stainless, nylon and ceramics are usable. Specifically, disk and inner wall of vessel made of ceramics such as zirconia or silicon carbide is preferred to the invention.

"Particles having reactive functional group with methacryl group" can be prepared by surface treatment with silane compound via above processing using a wet media dispersing type apparatus.

(Compound Formed by Reaction of Methacryl Group with Functional Group of Particles)

"Compound formed by reaction of methacryl group in polymerizable compound with functional group of particles" which is contained in the surface layer constituting the photoreceptor of the present invention will now be further detailed. The surface layer constituting the photoreceptor of the present invention is constituted by the compound formed by using "polymerizable compound having methacryl group" and "particles having reactive functional group with methacryl group" each described above and reacting of the methacryl group in the polymerizable compound with the functional group of the particles.

"Compound formed by reaction of methacryl group in polymerizable compound with functional group of particles" is provided as follows: Radical is generated by irradiating actinic energy radiation such as ultraviolet ray or electron beam and by an action of radical the methacryl group of the polymerizable compound reacts with the functional group of particles. As the result, polymerization reaction which forms cross-linkage between polymerizable compounds or between polymeraizable compound and particles proceeds and cured resin having cross-linked structure is formed. "Compound formed by reaction of methacryl group in polymerizable compound with functional group of particles" of the present invention constitutes cured resin obtained by radical polymerization via irradiating actinic energy radiation such as ultraviolet ray or electron beam.

Specifically, prepared is a coating solution in which resin and polymerization initiator described later are added as appropriate other than the polymerizable compound or particles described above, then this coating solution is coated on a surface of photosensitive layer by conventional method, and dried. The coated layer is irradiated by actinic energy radiation to generate radicals for polymerization reaction. Preferred is to provide cured resin by forming cross-linkage via intermolecular or intrarmolecular cross-linking reaction as above process. As an actinic energy radiation, preferred is ultraviolet ray or electron beam. Ultraviolet ray is specifically preferred in view of easy to use.

There is no particular restriction to the ultraviolet light source if ultraviolet rays can be emitted. It is possible to use a low pressure mercury lamp, intermediate pressure mercury lamp, high pressure mercury lamp, extra-high pressure mercury lamp, carbon arc lamp, metal halide lamp, xenon lamp, flash or pulse xenon and ultraviolet T ED. Irradiation conditions differ according to each lamp. The dose of actinic energy radiation is normally in the range of 1 to 20 mJ/cm$^2$, preferably in the range of 5 through 15 mJ/cm$^2$. The electric power of the lamp is preferably in the range of 0.1 kW through 5 kW, more preferably in the range of 0.5 kW through 3 kW.

There is no particular restriction to the electron beam irradiation apparatus as the electron beam source. The accelerator irradiation apparatus as the electron beam source include, generally, a curtain beam type that produces high power at less costs is effectively used as an electron beam accelerator for emitting the electron beam. The acceleration voltage at the time of electron beam irradiation is preferably in the range of 100 through 300 kV. The absorbed dose is preferably kept in the range of 0.5 through 10 Mrad.

The irradiation time to get the required dose of actinic energy radiation is preferably 0.1 second to 10 minutes, and is more preferably 0.1 second to 5 minutes.

When the polymerizable compound or particles in the present invention are put to react to cured resin having cross-linked structure, reaction by light and heat through addition of a radical polymerization initiator may be employable as well as reaction by electron beam cleavage. Either the polymerization initiator or thermal polymerization initiator can be employed. Further, both of these initiators can be used in combination The examples of the initiator include acetophenone or ketal polymerization initiators, benzoin ether polymerization initiators, benzophenone polymerization initiators, and thioxanthone polymerization initiators. Specific examples are listed below:

(1) acetophenone or ketal polymerization initiators:

diethoxy acetophenone, 2,2-dimethoxy-1,2-diphenylethane-1-on, 1-hydroxy-cyclohexyl-phenyl-ketone, 4-(2-hydreoxyethoxy)phenyl-(2-hydroxy-2-propyl)ketone, 2-benzyl-2-dimethylamino-1-(4-morpholine phenyl)butanone-1,2-hydroxy-2-methyl-1-phenyl propane-1-on, 2-methyl-2-morpholino(4-methylthiophenyl)propane-1-on, 1-phenyl-1,2-propane dione-2-(o-ethoxy carbonyl)oxime and others;

(2) benzoin ether polymerization initiators:

benzoin, benzoin methyl ether, benzoin ethyl ether, benzoin isobutyl ether, and benzoin isobutyl propyl ether;

(3) benzophenone polymerization initiators:

benzophenone, 4-hydroxy benzophenone, o-benzoyl methyl benzoate, 2-benzoyl naphthalene, 4-benzoyl biphenyl, 4-benzoyl phenyl ether, acrylated benzophenone, and 1,4-benzoyl benzene; and (4) thioxanthone polymerization initiators:

2-isopropyl thioxanthone, 2-chloro thioxanthone, 2,4-dimethyl thioxanthone, 2,4-diethyl thioxanthone, and 2,4-dichloro thioxanthone.

Other photo-polymerization initiators includes ethylanthracene, 2,4,6-trimethyl benzoyl diphenyl phosphine oxide, 2,4,6-trimethyl benzoyl phenyl ethoxy phosphine oxide, bis(2,4,6-trimethyl benzoyl)phenyl phosphine oxide, bis(2,4-dimethoxy benzoyl)-2,4,4-trimethyl pentyl phosphine oxide, methyl phenyl glyoxy ester, 9,10-phenanthrene, acridine compounds, triazine compounds, and imidazole compounds.

These polymerization initiators each can be used independently or two or more of them can be used in combination. The content of the polymerization initiator is in the range of 0.1 through 40 parts by mass with respect to 100 parts by weight of polymerizable compound, preferably in the range of 0.5 through 20 parts by mass.

Further, the following compound which has photopolymerization accelerating effect may be employed individually or in combinations with above photopolymerization initiator. Compound having photopolymerization accelerating effect include, for example, triethanolamine, methyldiethanolamine, 4-dimethylamino benzoic acid, 4-dimethylamino isoamyl benzoate, (2-dimethylamino)ethyl benzoate, and 4,4'-dimethylamino benzophenone.

As described above, in the photoreceptor of the present invention, the surface layer constituted by "Compound formed by reaction of methacryl group in polymerizable compound with functional group of particles" can be formed by employing irradiation of actinic energy radiation such as ultraviolet ray or electron beam and polymerization initiator. Herein, a thickness of the surface layer is preferably 0.2-10 μm, more preferably 0.5-6 μm.

The surface layer which constitutes the photoreceptor of the present invention can be provided by combination of conventional resin described below other than the resin provided by "Compound formed by reaction of methacryl group in polymerizable compound with functional group of particles". Specific examples of the conventional resin include polyester resin, polycarbonate resin, polyurethane resin, acryl resin, epoxy resin, silicone resin and alkyd resin.

Further, the surface layer which constitutes the photoreceptor of the present invention can be provided by containing filler, lubricant particles or antioxidant as appropriate other than above described resins. The filler, lubricant particles and the antioxidant will now be further detailed.

(Filler)

Addition of filler into the surface layer is preferable in view of enhancing a mechanical strength of the surface layer and arranging an electrical property (resistivity). Specific example of filler include metal oxide such as silica, alumina, zinc oxide, titanium oxide, tin oxide, antimony oxide, indium oxide and bismuth oxide; super fine particles such as antimony doped tin oxide and zirconium oxide. These may be employed individually or in combinations of at least two types. In the case of combination of at least two types, a state of solid solution or fusion may be also employable.

(Lubricant Particles)

Lubricant particles represented by resin particles containing fluorine atoms can be added to the surface layer in the present invention. The resin particles containing fluorine atoms are exemplified by ethylene tetrafluoride resin, ethylene trifluoride resin, ethylene hexafluoride propylene resin, vinyl fluoride resin, vinylidene fluoride resin, ethylene difluoride dichloro resin and copolymer resin thereof. These lubricant particles may be employed individually or in combinations of at least two types. Use of the ethylene tetrafluoride resin and vinylidene fluoride resin is particular preferred.

(Antioxidant)

Further, antioxidant may be added into the surface layer in view of enhancing weather resistivity of the photoreceptor. As an antioxidant, same one added in a charge transport layer described later can be employable.

Coating Liquid for Surface Layer)

When the surface layer which constitutes the photoreceptor of the present invention is provided, coating liquid for surface layer is prepared by adding at first "polymerizable compound having methacryl group" and "particles having reactive functional group with methacryl group", and as appropriate, conventional resin, polymerization initiator, filler, lubricant particles, and antioxidant. Then this coating liquid for surface layer is coated on a surface of photosensitive layer by conventional method, and dried naturally or by heating. After drying, the coated layer is irradiated by actinic energy radiation to initiate polymerization initiator for polymerization reaction, resulting in surface layer by forming cured resin layer.

The solvent for preparing the coating liquid for surface layer is exemplified by methanol, ethanol, n-propyl alcohol, isopropyl alcohol, n-butanol, t-butanol, sec-butanol, benzyl alcohol, toluene, xylene, methyl ethyl ketone, cyclohexane, ethyl acetate, butyl acetate, methyl cellosolve, ethyl cellosolve, tetrahydrofuran, 1,3-dioxane, 1,3-dioxolane, pyridine, and diethyl amine, without being restricted thereto.

As coating method, commonly known methods such as dip coating, spray coating, spinner coating, bead coating, blade coating, beam coating, and slide hopper coating methods can be employed.

Drying conditions for the surface layer coated on the photoreceptor surface can be properly determined in terms of solvent species used in coating liquid for surface layer or thickness of surface layer. As for drying temperature, preferable is room temperature to 180° C., more preferable 80° C.-140° C. As for drying time, preferable is 1 minute to 200 minutes, more preferable is 5 minutes to 100 minutes. Drying of surface layer can be carried out before and after above irradiation of actinic energy radiation and also during irradiation of actinic energy radiation. Thus, timing for drying can be selected in combination with irradiation condition of actinic energy radiation.

2. Conductive Support, Intermediate Layer and Photosensitive Layer

Conductive support, intermediate layer and photosensitive layer (charge generation layer, charge transport layer) which constitutes photoreceptor of the present invention and materials which constitutes photosensitive layer will now be detailed.

(Conductive Support)

There is no restriction to the support used in the present invention if it is conductive. The examples are: a drum or a sheet formed of such a metal as aluminum, copper, chromium, nickel, zinc and stainless steel; a plastic film laminated with such a metal foil as aluminum and copper; a plastic film provided with vapor deposition of aluminum, indium oxide, and tin oxide; and a metal, plastic film, or paper provided with a conductive layer by coating a conductive substance independently or in combination with a binder resin.

(Intermediate Layer)

The photoreceptor related to the present invention has conductive support provided thereon at least photosensitive layer and surface layer. An intermediate layer having a barrier function and adhesion function can be provided between the conductive layer and a photosensitive layer in the present invention. Thickness of the intermediate layer is preferably 0.1 to 15 μm, more preferably 0.3 to 10 μm.

To form the intermediate layer, such a binder resin as casein, polyvinyl alcohol, nitrocellulose, ethylene-acrylic acid copolymer, polyamide, polyurethane or gelatin is dissolved in a conventional solvent, and the intermediate layer can be formed by dip coating. Of these materials, alcohol soluble polyamide resin is preferably used.

In view of arranging resistivity of intermediate layer, various conductive fine particles or metal oxide may be included. Average particle diameter of these conductive fine particles or metal oxide is preferably 0.3 μm or less, more preferably 0.1 μm or less. For example, employable is metal oxide such as alumina, zinc oxide, tin oxide, antimony oxide, indium oxide, and bismuth oxide. Further, conductive particles such as tin doped indium oxide or antimony doped tin oxide or zirconium oxide is also employable. This metal oxide may be employed individually or in combinations of at least two types. In the case of mixing two or more types, solid solution or fusion state may be also available.

The solvent used for preparation of the intermediate layer is preferably capable of effective dispersion of inorganic particles such as conductive fine particles or metal oxide particles and dissolution of binder resins such as polyamide resin. The preferred solvent is exemplified by alcohols containing 2 through 4 carbon atoms such as ethanol, n-propyl alcohol, isopropyl alcohol, n-butanol, t-butanol, and sec-butanol having excellent polyamide resin dissolution and coating performances. Further, to improve the storage ability and particle dispersion, it is possible to use an auxiliary solvent which provides excellent effects when used in combination with the aforementioned solvent. The examples of such an auxiliary solvent are methanol, benzyl alcohol, toluene, cyclohexane, and tetrahydrofuran.

The concentration of the binder resin is selected as appropriate in conformity to the film thickness of the intermediate layer and production speed. When inorganic particles are dispersed in the binder resin, the amount of the mixed inorganic resin is preferably in the range of 20 through 400 parts by mass, more preferably in the range of 50 through 200 parts by mass, with respect to 100 parts by mass of the binder resin.

The method for dispersing various conductive particles or metal oxide particlen into coating solution include an ultrasonic homogenizer, ball mill, sand grinder, and homomixer, without being restricted thereto.

The method of drying the intermediate layer can be selected from conventional drying method as appropriate in conformity to the type of solvent and film thickness. The method of drying by heat is preferably used.

(Photosensitive Layer)

As the photosensitive layer related to the present invention, as well as a single layer structure type in which both charge generation function and charge transport function are combined in single layer, preferred is a photosensitive layer having a functional separation type layer constitution in which charge generation layer (CGL) having charge generation function and charge transport layer (CTL) having charge transport function are separated. By employing a photosensitive layer having a functional separation type layer constitution, it results in advantage in which several electrophotographic properties can be easily controlled for its purpose, as well as an increase of residual potential can be controlled to be small in case of repeatedly usage.

Layer constitution of negative charge photoreceptor comprises intermediate layer, provided thereon charge generation layer (CGL) and then charge transport layer (CTL). On the other hand, layer constitution of positive charge photoreceptor is the reverse constitution of layer constitution of negative charge photoreceptor. Among these photoreceptors, preferred is layer structure of negative charge photoreceptor.

As a specific example of photoreceptor, charge generation layer and charge transport layer which constitutes photoreceptor of negative charge photoreceptor will now be detailed.

(Charge Generation Layer)

Charge generation layer is preferably a layer that contains a charge generation material (CGM) and a binder resin, and is formed by dispersing the charge generation material in the binder resin solution, and coating the same.

Charge generation layer includes charge generation material (CGM) and may include binder resin or conventional additives as appropriate other than charge generation material.

The charge generation material is exemplified by an azo material such as Sudan Red and Diane Blue; quinone pigment such as pyrene quinone and anthanthrone; quinocyanine pigment; perylene pigment; indigo pigment such as indigo and thioindigo; and phthalocyanine pigment. These charge generation materials can be used independently or in the form dispersed in the resin.

The conventional resin can be used as the binder resin of the charge generation layer. Such a resin is exemplified by polystyrene resin, polyethylene resin, polypropylene resin, acryl resin, methacryl resin, vinyl chloride resin, vinyl acetate resin, polyvinyl butyral resin, epoxy resin, polyurethane resin, phenol resin, polyester resin, alkyd resin, polycarbonate resin, silicone resin, melamine resin, copolymer resin containing two or more of these resins (e.g., vinyl chloride-vinyl acetate copolymer, vinyl chloride-vinyl acetate-anhydrous maleic acid copolymer), and polyvinyl carbazole resin, without being restricted thereto.

The charge generation layer is preferably formed as follows: The charge generation material is dispersed by a homogenizer into solution obtained by dissolving a binder resin in solvent, whereby a coating composition is prepared. Then the coating composition is coated to a predetermined thickness using a coating device. After that, the coated film is dried, whereby the charge generation layer is formed.

The examples of the solvent used for dissolving the binder resin used for preparing the charge generation layer and coating include toluene, xylene, methyl ethyl ketone, cyclohexane, ethyl acetate, butyl acetate, methanol, ethanol, propanol, butanol, methyl cellosolve, ethyl cellosolve, tetrahydrofuran, 1-dioxane, 1,3-dioxolane, pyridine and diethyl amine, without being restricted thereto.

An ultrasonic homogenizer, ball mill, sand grinder, and homomixer can be used to disperse the charge generation material, without being restricted thereto.

The amount of the charge generation material is preferably 1 through 600 parts by mass of the charge generation material, more preferably 50 through 500 parts by mass, with respect to 100 parts by mass of binder resin. The film thickness of the charge generation layer differs according to the characteristics of the charge generation material and binder resin and percentage of mixture, and is preferably 0.01 through 5 μm, more preferably 0.05 through 3 μm. An image defect can be prevented from occurring by filtering out the foreign substances and coagulants before applying the coating composition for the charge generation layer. It can be formed by vacuum evaporation coating of the aforementioned pigment.

(Charge Transport Layer)

The charge transport layer used in the photosensitive layer contains a charge transport material and binder resin, and is formed by dissolving the charge transport material in the binder resin and coating the same.

The charge transport material is exemplified by carbazole derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compound, hydrazone compound, pyrazoline compound, oxazolone derivatives, benzimidazole derivatives quinazoline derivatives, benzofuran derivatives, acridine derivatives, phenazine derivatives, aminostilbene derivatives, triarylamine derivatives, phenylene diamine derivatives, stilbene derivatives, benzidine derivatives, poly-N-vinyl carbazole, poly-1-vinyl pyrene, and poly-9-vinyl anthracene. These compounds may be used individually or in combinations of at least 2 types.

The conventional resin can be used as the binder resin for the charge transport layer. The examples include polycarbonate resin, polyacrylate resin, polyester resin, polystyrene resin, styrene-acrylonitrile copolymer resin, polymethacrylate ester resin, and styrene-methacrylate ester copolymer.

The charge transport layer can be formed by conventional method represented by coating method. For example, by the coating method, the charge transport layer is formed by dissolving binder resin and a charge transport material to prepare a coating composition, which is then applied to the layer to a predetermined thickness. Then the coating layer is dried.

The examples of the solvent for dissolving the binder resin and charge transport materials include toluene, xylene, methyl ethyl ketone, cyclohexanone, ethyl acetate, butyl acetate, methanol, ethanol, propanol, butanol, tetrahydrofuran, 1,4-dioxane, 1,3-dioxolane, pyridine, and diethyl amine, without being restricted thereto.

The amount of charge transport material is preferably in the range of 10 through 500 parts by mass of charge transport material, more preferably in the range of 20 through 100 parts by mass, with respect to 100 parts by mass of binder resin.

The thickness of the charge transport layer varies according to the characteristics of the charge transport material and binder resin, and percentage of mixture, and is preferably 5 through 40 μm, more preferably 10 through 30 μm.

A conventional antioxidant, electronic conductive agent, and stabilizer can be applied to the charge transport layer. The antioxidants listed in Japanese Patent Application No. 11-200135, and electronic conductive agents or stabilizers listed in JP-A S50-137543 and JP-A S58-76483 are preferably used.

Each layer constituting the photoreceptor of the present invention such as the intermediate layer, charge generation layer and charge transport layer can be coated according to such well-known methods as dip coating, spray coating, spinner coating, bead coating, blade coating, beam coating, and slide hopper coating methods.

3. Image Forming Apparatus and Method for Image Formation

Image forming apparatus and method for image formation related to the present invention will now be detailed.

Image forming apparatus which realizes the effect of the present invention comprises at least constitutions below.

(1) An electrophotographic photoreceptor comprising an electroconductive support provided thereon a surface layer which contains a compound obtained by reacting a polymerizable compound the having a ratio between the number of methacryl groups and the molecular weight is 0.0055 or more and particles containing a functional group reactive with the methacryl group; and a photosensitive layer, (2) a charging member which charges the electrophotographic photoreceptor without touching, (3) an exposure member which exposes on the charged electrophotographic photoreceptor by the charging member, and (4) a developing member which supplies a developer onto the exposed electrophotographic photoreceptor by the exposure member.

An exposure member forms a latent image by an image wise exposure on a charged electrophotographic photoreceptor by a charging member. A developing member supplies a developer onto the exposed electrophotographic photoreceptor and toner image is fowled by visualizing from latent image formed by the exposure member. Further, the image forming apparatus of the present invention may comprise a transfer member which transfers the toner image formed on the electrophotographic photoreceptor by the developing member to a transfer medium such as paper or transfer belt.

As the charging member which institutes the image forming apparatus of the present invention, preferred is "non-contact charging device" which charges without touching electrophotographic photoreceptor.

"Non-contact charging device" does not give any load by contact onto photoreceptor at charging process, resulting in no concern about deterioration of photoreceptor due to contact of charging device. For example, it is preferable in the case of printing a large amount such as 10 million or more papers. Specific examples of "Non-contact charging device" related to the present invention include corona discharge device, corotron discharge device, and scorotron discharge device.

Figure 2:
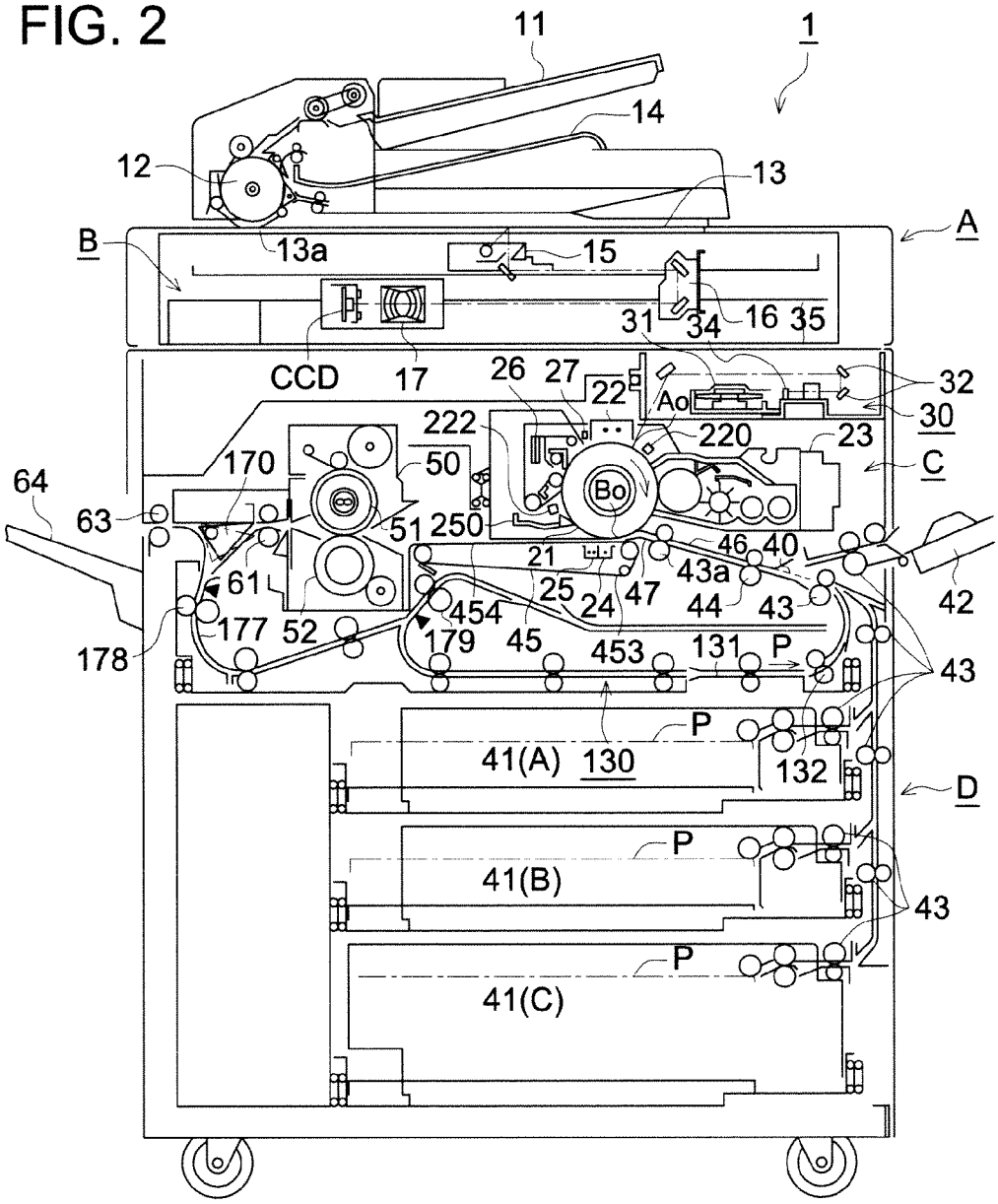
FIG. 2 is a sectional constitution view of an image forming apparatus utilizing an organic photoreceptor of the present invention.

An image forming apparatus related to the present invention will be exemplified with the reference to FIG. 2. FIG. 2 is a sectional constitution view of an image forming apparatus which can utilize an organic photoreceptor of the present invention.

The image forming apparatus 1 shown in FIG. 2 is a digital type image forming apparatus, and is structured by an image reading section A, image processing section B, image forming section C, and transfer sheet conveyance section D.

An automatic document feeding unit to automatically convey documents is provided on the upper portion of the image reading section A, and the documents placed on a document placement board 11 are separated one by one sheet and conveyed by a document conveyance roller 12, and an image is read at a reading position 13*a*. The document, whose reading is completed, is delivered by the document conveyance roller 12 onto a document sheet delivery tray 14.

An image of the document when it is placed on a platen glass 13, is read out by a reading operation at a speed of v of the first mirror unit 15 which is composed of an illumination lamp and the first mirror, and by a moving exposure at a speed of v/2 of the second mirror unit 16 in the same direction which is composed of the second mirror and the third mirror, which are positioned in V-letter shape, wherein the first mirror unit 15 and the second mirror unit constitute a scanning optical system.

The read image is formed on the light receiving surface of an image pick-up element CCD, which is a line sensor, through a projection lens 17. A line-shaped optical image formed on the image pick-up element CCD is successively electro-optical converted into electrical signal (brightness signal), then A/D converted, and after processing such as density conversion, filter processing, or the like, is conducted in an image processing section B, the image data is temporarily stored in a memory.

In the image forming section C, as image forming units, around the outer periphery of a drum-like photoreceptor 21 (image carrier), a non-contact charging member 22 to charge on the photoreceptor 21, a potential detecting device 220 to detect the charged potential on the photoreceptor, a developing member 23, a transfer belt 45 as a transferring member, a cleaning unit 26 cleaning the photoreceptor 21 (cleaning process), and pre-charge lamp (PCL) 27 eliminating potential by light on the photoreceptor (eliminating potential by light process) are respectively arranged in the order of operation. A reflective density meter 222, which measures reflective density of developed patch image, is equipped on the photoreceptor at the down stream of the developer 23. The photoreceptor drum 21 according to this invention is rotated clockwise in the drawing.

In an image forming section C constituting the image forming apparatus shown in FIG. 2, at least process below are carried out:

(1) a charging process in which the electrophotographic photoreceptor is charged without touching, (2) an exposure process in which the electrophotographic photoreceptor charged by the charging process is exposed, and (3) a developing process in which developer is supplied onto the exposed electrophotographic photoreceptor. Specifically, after uniform charging by the charging member 22 is conducted on the rotating the photoreceptor 21, without touching (charging process). Then, image exposure is conducted by an exposure optical system as the exposure member 30 according to an image signal read from the memory of the image processing section B (exposure process). The exposure optical system of the exposure member 30, which is a writing unit, uses a laser diode, not shown, as a light emitting source, and an optical path is changed by a reflection mirror 32 through a rotating polygonal mirror 31, fθ lens 34, and cylindrical lens 35, and the primary scanning is conducted. The image exposure is conducted at position Ao on the photoreceptor drum 21, and a latent image is formed by the rotation (the subsidiary scanning) of the photoreceptor drum 21. In the present example, exposure is conducted on a portion having characters and a reversal latent image is formed.

In the image forming apparatus 1, a semiconductor laser or an emission diode is employed for image exposure light source to form a latent image on the photoreceptor. An electrophotographic image having 400 through 2,500 dpi (dpi: number of dots per 2.54 cm) high definition can be obtained by employing these exposing light source with exposing laser light beam spot of 10-80 μm in the primary scanning direction and exposing digitally.

The laser light beam spot is a radius of a length of exposing beam (Ld) measured at the maximum position along with a primary scanning direction in an area having exposing intensity of more than $1/e^2$ times of peak intensity of the exposing light beam.

Image exposure is conducted by light beam employing a scanning optical system such as semiconductor laser, and a solid scanner such as LED. The light beam intensity distribution includes Gaussian, Lorentzian and so on. The area having exposing intensity of more than $1/e^2$ times of peak intensity of the exposing light beam is the light beam spot.

The latent image on the photoreceptor drum 21 is reversal-developed by the developing unit 23, and a visual image by a toner is formed on a surface of the photoreceptor drum 21 (developing process). A polymerization toner for the developer is preferably used to the developing member in the image forming method of the present invention. In the case of printing a large amount such as 10 million or more papers, a printing image having better sharpness can be obtained by employing the polymerization toner having uniform shape and particle size distribution in combination with the photoreceptor of the present invention.

In the transfer sheet conveyance section D, sheet feed units 41(A), 41(B), and 41(C) in which different sized transfer sheet P are accommodated, are provided in the lower portion of the image forming unit, and on the side portion, a manual sheet feed unit 42 to conduct the manual sheet feed is provided, and the transfer sheet selected from any one of these sheet feed units, is fed along a sheet feed path 40 by a guiding roller 43. The transfer sheet P is temporarily stopped and then fed by the register roller 44 by which inclination and deflection of the feeding transfer sheet are corrected, and through a sheet feed path 40, a pre-transfer roller 43*a*, a paper providing pass 46 and an entrance guide plate 47.

After passing through an entrance guide plate 47, the transfer sheet P is fed to a transfer conveyance belt 454 of a transfer conveyance belt device 45 and the toner image on the photoreceptor drum 21 is transferred onto the transfer sheet P at the transfer position Bo by the transfer electrode 24 and separation electrode 25, during conveyed via transfer conveying belt 454 of the transfer conveying unit 45. The transfer sheet P is separated from the photoreceptor drum 21 surface, and conveyed to the fixing unit 50 by the transfer conveying unit 45.

The fixing unit 50 has a fixing roller 51 and a pressure roller 52, and the transfer sheet passes between the fixing roller 51 and the pressure roller 52, thereby, toner is fused by heat and pressure. The transfer sheet P, on which the toner image has been fixed, is delivered onto the sheet delivery tray 64.

The situation for image forming on one side of the image receiving sheet is described above. When the copies are made on both sides of the sheet, the paper outputting course changing member 170 is switched so that the transfer paper guiding member 177 is opened and the transfer paper P is conveyed in the lower direction.

The transfer paper P is conveyed to the lower direction by a conveying mechanism 178 and switch-backed, so as to become the tail of the paper to top, and guided into a paper supplying unit for double-face copying 130.

The transfer paper P is conveyed to paper supplying direction on the conveying guide 131 provided in the paper supplying unit for double-face copying 130 and re-supplied by the paper supplying roller 132 and guided to the conveying course 40.

The transfer paper P is conveyed to the photoreceptor 21 and a toner image is transferred onto the back side of the transfer paper P, and output onto the paper output tray 64 after fixing the toner image by the fixing unit 50, as mentioned above.

In the image forming method according to the invention, the photoreceptor and another member such as the developing member and the cleaning device may be combined as a unit of a processing cartridge which can be freely installed to and released from the main body of the apparatus. Besides, at least one of the charging member, imagewise exposure member, developing member, transferring or separating member and cleaning device may be unitized with the photoreceptor to form a processing cartridge which is able to be freely installed to or released from the main body of the apparatus using a guiding means such as a rail.

EXAMPLES

Embodiments of the present invention will now be specifically described with the reference to examples, however the present invention is not limited thereto.

1. Preparation of "Particles 1-11 Having Reactive Functional Group with Methacryl Group (Hereinafter, Refer to as "Particles 1-11")" and "Particles 12 and 13" for Comparative Examples (1) Preparation of "Particles 1"

The following compounds were mixed and dispersed by a wet type sand mill having 0.5 mm diameter of alumina beads for 6 hours at 30° C.

| | |
|---|---|
| Titanium oxide particles 1 (number average primary particle diameter: (6 nm) | 100 parts by mass |
| Exemplified compound S-15 | 30 parts by mass |
| Methylethyl ketone | 1,000 parts by mass |

After mixing treatment above, followed by filtering off methyl ethyl ketone and alumina beads and drying at 60° C., "Particles 1" were prepared.

(2) Preparation of "Particles 2"

"Particles 2" were prepared in the same manner as Preparation of "Particles 1" except that "Titanium oxide particles 2 (number average primary particle diameter: 15 nm)" were used in place of "Titanium oxide particles 1" and 20 parts by mass of "Exemplified compound S-7" was used in place of 30 parts by mass of "Exemplified compound S-15".

(3) Preparation of "Particles 3"

"Particles 3" were prepared in the same manner as Preparation of "Particles 1" except that "Titanium oxide particles 3 (number average primary particle diameter: 35 nm)" were used in place of "Titanium oxide particles 1" and 10 parts by mass of "Exemplified compound S-13" was used in place of 30 parts by mass of "Exemplified compound S-15".

(4) Preparation of "Particles 4"

"Particles 4" were prepared in the same manner as Preparation of "Particles 1" except that "Titanium oxide particles 2 (number average primary particle diameter: 100 nm)" were used in place of "Titanium oxide particles 1" and a content of "Exemplified compound S-15" was changed to 35 parts by mass.

(5) Preparation of "Particles 5"

"Particles 5" were prepared in the same manner as Preparation of "Particles 1" except that "Alumina particles 1 (number average primary particle diameter: 30 nm)" were used in place of "Titanium oxide particles 1" and a content of "Exemplified compound S-15" was changed to 15 parts by mass.

(6) Preparation of "Particles 6"

"Particles 6" were prepared in the same manner as Preparation of "Particles 1" except that "Alumina particles 2 (number average primary particle diameter: 10 nm)" were used in place of "Titanium oxide particles 1" and a content of "Exemplified compound S-15" was changed to 25 parts by mass.

(7) Preparation of "Particles 7"

"Particles 7" were prepared in the same manner as Preparation of "Particles 1" except that "Silica particles 1 (number average primary particle diameter: 10 nm)" were used in place of "Titanium oxide particles 1" and 25 parts by mass of "Exemplified compound S-7" was used in place of 30 parts by mass of "Exemplified compound S-15".

(8) Preparation of "Particles 8"

"Particles 8" were prepared in the same manner as Preparation of "Particles 1" except that "Silica particles 2 (number average primary particle diameter: 50 nm)" were used in place of "Titanium oxide particles 1" and a content of "Exemplified compound S-15" was changed to 10 parts by mass.

(9) Preparation of "Particles 9"

"Particles 9" were prepared in the same manner as Preparation of "Particles 1" except that "Zirconia particles (number average primary particle diameter: 100 nm)" were used in place of "Titanium oxide particles 1" and a content of "Exemplified compound S-15" was changed to 5 parts by mass.

(10) Preparation of "Particles 10"

"Particles 10" were prepared in the same manner as Preparation of "Particles 1" except that "Acryl resin particles (number average primary particle diameter: 100 nm)" were used in place of "Titanium oxide particles 1" and 5 parts by mass of "Exemplified compound S-7" was used in place of 30 parts by mass of "Exemplified compound S-15".

(11) Preparation of "Particles 11"

"Particles 11" were prepared in the same manner as Preparation of "Particles 1" except that "Tin oxide particles (number average primary particle diameter: 15 nm)" were used in place of "Titanium oxide particles 1" and a content of "Exemplified compound 5-15" was changed to 20 parts by mass.

(12) Preparation of "Particles 12" (Comparative Example)

"Particles 12" were prepared in the same manner as Preparation of "Particles 1" except that "Titanium oxide particles 2 (number average primary particle diameter: 15 nm)" were used in place of "Titanium oxide particles 1" and 20 parts by mass of "Isobutyl trimethoxy silane" was used in place of 30 parts by mass of "Exemplified compound S-15".

(13) Preparation of "Particles 13" (Comparative example)

"Particles 13" were prepared in the same manner as Preparation of "Particles 1" except that "Titanium oxide particles 2 (number average primary particle diameter: 15 nm)" were used in place of "Titanium oxide particles 1" and "Exemplified compound S-15" was not used.

2. Preparation of "Photoreceptors 1-17"

(1) Preparation of "Photoreceptor 1"

(Preparation of Electroconductive Support)

The cylinder type aluminum support was prepared by cutting work, which surface has surface roughness Rz of 1.5 μm.

Preparation of Intermediate Layer)

Dispersion containing the following components was diluted to twice by methanol, followed by standing one night (8 hours) and filtering with filter (Rigimesh 5 μm filter manufactured by Nihon Pole Ltd.) and coating composition for intermediate layer was obtained.

The following composition was dispersed in batch process for ten hours employing a sand mill dispersion apparatus in batch to prepare a coating composition for intermediate layer.

| | |
|---|---|
| Polyamide resin CM8000, manufactured by Toray Industry Inc. | 1 part |
| Tin oxide SMT500SAS, manufactured by TAYCA CORPORATION | 3 parts |
| Methanol | 10 parts |

The coating composition was applied on to the electroconductive support by dipping so as to obtain an intermediate layer having thickness of 2 μm after drying.

(Preparation of Charge Generation Layer)

The following components were mixed and dispersed by a sand mill for ten hours to prepare a coating composition for charge generation layer.

Charge generation material: Titanyl phthalocyanine pigment, having

| | |
|---|---|
| a maximum peak at 27.3° based on a Cu—Kα characteristic X-ray diffraction spectrum measurement | 20 part |
| Polyvinylbutyral resin (#6000-C, manufactured by Denkikagaku Kogyo Kabushiki Kaisha) | 10 parts |
| t-Butyl acetate | 700 parts |
| 4-Methoxy-4-methyl-2-pentanone | 300 parts |

The coating composition was coated on the intermediate layer by dipping method and dried to form a charge generation layer having dry thickness of 0.3 μm.

(Preparation of Charge Transport Layer)

The following components were mixed and solved to form a coating composition for charge transport layer.

| | |
|---|---|
| Charge transport material: 4,4'-Dimethyl-4''-(β-phenylstyryl) triphenylamine | 225 parts |

-continued

| | |
|---|---|
| Binder: Polycarbonate (Z300: manufactured by Mitsubishi Gas Chemical Company, Inc.) | 300 parts |
| Antioxidant (Irganox1010, manufactured by Ciba Japan) | 6 parts |
| Tetrahydrofuran (THF) | 1,600 parts |
| Toluene | 400 parts |
| Silicone oil (KF-54: manufactured by Shin-Etsu Chemical Co., Ltd.) | 1 part |

The above coating composition for charge transport layer was coated on the charge generation layer by circular slide hopper type coater and dried to form a charge transport layer having dry thickness of 20 μm.

(Preparation of Surface Layer)

The following components were put into disperser to prepare a coating composition for surface layer.

| | |
|---|---|
| "Particles 1" which has functional group reactive with methacryl group | 10 parts |
| Polymerizable compound "Exemplified example (39)" | 10 parts |
| Polymerization initiator ((Irgacure-369, manufactured by Ciba Japan) | 10 parts |
| 1-Propyl alcohol | 40 parts |

This coating composition was coated on photoreceptor having the charge transport layer via circular slide hopper coating machine to form surface layer. After formed surface layer was dried, ultraviolet ray was irradiated onto the surface layer by metal halide lamp under nitrogen gas stream, whereby the polymerizable compound having methacryl group and the particles having functional group reactive with methacryl group were reacted to form compound, resulting in forming the surface layer containing this compound having dry thickness of 2 μm. Irradiation of ultraviolet ray was carried out at the position of 100 mm apart with output of halide lamp 4 kW in 1 minute. "Photoreceptor 1" was formed according to above procedure.

(2) Preparation of "Photoreceptor 2-13 and 15-17"

"Photoreceptors 2-13 and 15-17" were prepared in the same manner as "Photoreceptor 1" except that polymerizable compound "Exemplified compound (39)" and "Particles 1 having reactive functional group with methacryl group" which were employed for preparation of surface layer were changed to corresponding component listed in Table 1 described later.

For "Photoreceptors 12 and 13", surface layers were prepared by using polymerizable compound "Exemplified compound (41) and (42)". "The ratio between the number of methacryl groups and the molecular weight (ratio of mass)-" of "Exemplified compound (41)" and "Exemplified compound (42)" were 0.0039 and 0.0052, respectively and both were less than 0.0055.

| Exemplified example No. | Chemical structure | Methacrylic acid group | Ratio |
|---|---|---|---|
| (41) | $R-(OCH_2CH_2CH_2CH_2CH_2\overset{O}{\overset{\|\|}{C})_2}-OCH_2-\underset{CH_3}{\overset{CH_3}{C}}-\overset{O}{\overset{\|\|}{C}}OCH_2O-(\overset{O}{\overset{\|\|}{C}}H_2CH_2CH_2CH_2CH_2O)_2-R$ | 2 | 0.0039 |

-continued

| Exemplified example No. | Chemical structure | Methacrylic acid group | Ratio |
|---|---|---|---|
| (42) | $R—OCH_2\overset{OH}{\overset{\vert}{C}}HCH_2OCH_2CH_2CH_2CH_2CH_2—OCH_2\overset{O}{\overset{\Vert}{C}}HCH_2O—R$ | 2 | 0.0052 |

In preparation of "Photoreceptor 17", surface layer was formed without ultraviolet ray irradiation by metal halide lamp described above but only by drying.

(3) Preparation of "Photoreceptor 14"

"Photoreceptor 14" was prepared in the same manner as "Photoreceptor 1" except that "Comparative compound" having following structure was used in place of polymerizable compound "Exemplified compound (39)" which was used for forming a surface layer.

Comparative Compound

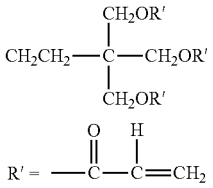

In Table 1, listed are "polymerizable compound", "particles having reactive functional group with methacryl group", ratio of number of methacryl group of "polymerizable compound" and molecular weight (mass ratio), and "existence or nonexistence of compound obtained by reacting polymerizable compound having at least methacryl group with particles having reactive functional group with methacryl group" used in "Photoreceptors 1-17".

[Evaluation of Photoreceptor]

Photoreceptor was evaluated by mounting on commercially available Image forming apparatus "bizhub PRO C6500" (produced by Konica Minolta Business Technologies, Inc. Herein, evaluations for "Photoreceptors 1-11" are referred to as "Examples 1-11" and evaluations for "Photoreceptors 12-17" are referred to as "Comparative Examples 1-6".

Herein, surface of "Photoreceptor 17" was so soft that it cannot install to the image forming apparatus. Therefore it was eliminated from the evaluation.

Under the ambient condition of temperature of 20° C., relative humidity of 50% and printing area ratio of 5%, printing was continued to one million papers by using each photoreceptor. After that, evaluation for wear amount, uneven density, abrasion lines and defect of image caused by abrasion lines were carried out. Further, under the ambient condition of temperature of 30° C., relative humidity of 85% and printing area ratio of 5%, printing was continued to one million papers. After standing 12 hours from finishing above continuous printing, text image was printed again and image blur was evaluated.

<Wear amount of Photoreceptor>

Wear amount of photoreceptor surface was calculated by measuring a layer thickness of photoreceptor at initial and after printing one million papers via eddy current type thickness meter. Wear amount of 3 μm or less was acceptable. Measurement of wear amount via eddy current type thickness meter was defined by an average thickness of photoreceptor at twenty points in random.

TABLE 1

| | Polymerizable compound | | Particles having reactive functional group with methacryl group | | | | | |
|---|---|---|---|---|---|---|---|---|
| | | | | Particle condition | | Surface treatment | | |
| Photoreceptor No. | Exemplified compound No. | Ratio (Methacrylic acid/Molecular weight) | Particle No. | Species | Particle size (nm) | Silane compound | Content (parts by mass) | Compound (*2) |
| 1 | 39 | 0.0059 | 1 | Titanium oxide particle 1 | 6 | S-15 | 30 | Exist |
| 2 | 9 | 0.0064 | 2 | Titanium oxide particle 2 | 15 | S-7 | 20 | Exist |
| 3 | 27 | 0.0077 | 3 | Titanium oxide particle 3 | 35 | S-13 | 10 | Exist |
| 4 | 40 | 0.0083 | 4 | Titanium oxide particle 4 | 100 | S-15 | 5 | Exist |
| 5 | 28 | 0.0098 | 5 | Aluminum oxide particle 1 | 30 | S-15 | 15 | Exist |
| 6 | 28 | 0.0098 | 6 | Aluminum oxide particle 2 | 10 | S-15 | 25 | Exist |
| 7 | 1 | 0.0089 | 6 | Aluminum oxide particle 2 | 10 | S-15 | 25 | Exist |
| 8 | 28 | 0.0098 | 7 | Silica particle 1 | 10 | S-7 | 25 | Exist |
| 9 | 28 | 0.0098 | 8 | Silica particle 2 | 50 | S-15 | 10 | Exist |
| 10 | 28 | 0.0098 | 9 | Zirconia particle | 100 | S-15 | 5 | Exist |
| 11 | 27 | 0.0077 | 10 | Acryl resin particle | 100 | S-7 | 5 | Exist |
| 12 | 41 | 0.0039 | 11 | Tin oxide particle | 15 | S-15 | 20 | Exist |
| 13 | 42 | 0.0052 | 2 | Titanium oxide particle 2 | 15 | S-7 | 20 | Exist |
| 14 | — | — | 2 | Titanium oxide particle 2 | 15 | S-7 | 20 | Exist |
| 15 | 27 | 0.0077 | 12 | Titanium oxide particle 2 | 15 | *1 | 20 | Exist |
| 16 | 27 | 0.0077 | 13 | Titanium oxide particle 2 | 15 | — | — | Exist |
| 17 | 27 | 0.0077 | 2 | Titanium oxide particle 2 | 15 | S-7 | 20 | None |

*1: Isobutyltrimethoxysilane (*2): Compound obtained by reacting polymerizable compound having at least methacryl group with particles having reactive functional group with methacryl group Particle size in Particle condition represents Average primary particle diameter.

<Uneven Density of Image>

After finishing printing one million papers, halftone image with image density of 0.4 was printed. State of uneven density of image on the print was observed and ranked according to bellows. Criteria A and B were thought to be acceptable.

Evaluation criteria:

A: No uneven density is noted.

B: Slight uneven density is noted, but it is practically unproblematic.

C: Uneven density is clearly observed and practically problematic.

<Surface Abrasion Lines and Defect of Image Caused by Abrasion Lines>

After continuous printing one million papers, abrasion lines on the surface of the photoreceptor was observed by visual inspection and also defect of image on above halftone image with image density of 0.4 was observed by visual inspection.

Evaluation criteria:

A: No abrasion line is noted on the photoreceptor and no defect of image on the printed image.

B: Slight abrasion line is noted on the photoreceptor but no defect of image on the printed image.

C: Abrasion line is observed on the photoreceptor and defect of image is observed on the printed image.

<Blur of Image>

After standing 12 hours from finishing printing one million papers under ambient condition 30° C., 85 R.H, text image having printing area ratio of 5%, was printed again and printed image was observed by visual inspection.

Evaluation criteria:

A: No blur is noted on text image.

B: Little blur is noted on text image.

C: Blur is noted on text image and is practically problematic.

Evaluation results are listed in Table 2.

TABLE 2

| | Photo-receptor No. | Wear amount (μm) | Uneven density | Abrasion lines* | Blur of Image |
|---|---|---|---|---|---|
| Example 1 | 1 | 1.2 | B | B | A |
| Example 2 | 2 | 0.9 | B | B | B |
| Example 3 | 3 | 0.8 | B | B | A |
| Example 4 | 4 | 0.7 | A | A | A |
| Example 5 | 5 | 0.2 | A | A | A |
| Example 6 | 6 | 0.3 | A | A | A |
| Example 7 | 7 | 0.5 | A | A | A |
| Example 8 | 8 | 0.5 | A | A | B |
| Example 9 | 9 | 0.4 | A | A | B |
| Example 10 | 10 | 0.4 | A | A | A |
| Example 11 | 11 | 2.8 | B | B | B |
| Comparative 1 | 12 | 4.2 | D | D | A |
| Comparative 2 | 13 | 3.1 | B | D | B |
| Comparative 3 | 14 | 0.2 | A | A | D |
| Comparative 4 | 15 | 3.3 | B | D | B |
| Comparative 5 | 16 | 4.8 | B | D | D |
| Comparative 6 | 17 | — | — | — | — |

Abrasion lines*: Abrasion lines and defects of image caused by abrasion lines.

As can be clearly seen from the results described in Table 2, it is found that "Photoreceptors 1-11" which satisfy the constitution of the present invention exhibit wear amount of 3 μm or less, no uneven density and enhance abrasion resistance. Further, it is found that after continuous printing to one million papers under the ambient of high temperature and high humidity, blur of image does not occur and excellent image quality can be stably printed. On the other hand, it is found that "Comparative examples 1-6" which does not satisfy the constitution of the present invention exhibits practically problematic in either evaluation item and has no effect of the present invention.

DESCRIPTION OF THE ALPHANUMERIC DESIGNATIONS

1: Electroconductive support
2: Photosensitive layer
3: Intermediate layer
4: Charge generation layer
5: Charge transport layer
6: Surface layer
7: Particles
21: Electrophotographic photoreceptor
22: Non-contact charging device
30: Exposure device
23: Developing device

What is claimed is:

1. An electrophotographic photoreceptor comprising an electroconductive support provided thereon at least a photosensitive layer and a surface layer, wherein the surface layer contains at least a compound obtained by reacting a polymerizable compound containing a methacryl group with particles containing a functional group reactive with the methacryl group and, in the polymerizable compound, the ratio between the number of methacryl groups and the molecular weight (number of methacryl groups/molecular weight) is 0.0055 or more.

2. The electrophotographic photoreceptor of claim 1, wherein in the polymerizable compound, the ratio between the number of methacryl groups and the molecular weight (number of methacryl groups/molecular weight) is 0.0055 or more and 0.0100 or less.

3. The electrophotographic photoreceptor of claim 1, wherein particles are formed by using metal oxide particles.

4. The electrophotographic photoreceptor of claim 1, wherein particles are treated by a coupling agent.

5. An image forming apparatus at least comprising:

the electrophotographic photoreceptor of claim 1, a charging member which charges the electrophotographic photoreceptor without touching, an exposure member which exposes on the charged electrophotographic photoreceptor by the charging member, and a developing member which supplies a developer onto the exposed electrophotographic photoreceptor by the exposure member.

6. A method for n image forming comprising steps of:

charging the electrophotographic photoreceptor of claim 1 without touching, exposing the charged electrophotographic photoreceptor by the charging step, and developing by supplying a developer onto the exposed electrophotographic photoreceptor by the exposing step.

* * * * *